US005305937A

United States Patent [19]

Barnett

[11] Patent Number: 5,305,937

[45] Date of Patent: Apr. 26, 1994

[54] DISPENSER FOR SUPPLIES

[76] Inventor: Sharon R. Barnett, P.O. Box 86, Thornton, Tex. 76687

[21] Appl. No.: 68,423

[22] Filed: May 27, 1993

Related U.S. Application Data

[63] Continuation-in-part of Ser. No. 928,305, Aug. 12, 1992, abandoned.

[51] Int. Cl.[5] ..... B26F 3/02; B65H 16/02

[52] U.S. Cl. ..... 225/7; 225/37; 225/42; 225/43; 225/46; 83/650; 242/55.42; 242/55.53

[58] Field of Search ..... 225/7, 34, 37, 38, 39, 225/42, 43, 46, 53, 77, 52; 242/55.3, 55.42, 55.53, 55.54; 83/614, 649, 650

[56] References Cited

U.S. PATENT DOCUMENTS

| | | | |
|---|---|---|---|
| D. 284,722 | 7/1986 | Beckerman | D6/520 |
| 548,987 | 10/1895 | Heyman | 242/55.42 |
| 1,518,750 | 12/1924 | Nelson | 225/38 |
| 2,250,236 | 7/1941 | Russell | 225/7 |
| 2,275,183 | 3/1942 | Josephs | 225/43 X |
| 2,722,387 | 11/1955 | Tuttle | 225/46 X |
| 2,969,169 | 1/1961 | Botnick | 225/38 X |
| 2,978,156 | 4/1961 | Yaniello | 225/43 X |
| 3,142,426 | 7/1964 | Busse | 225/43 |
| 3,603,519 | 9/1971 | Brown et al. | 225/38 X |
| 4,369,929 | 1/1983 | Cayer | 242/55.42 |
| 4,645,107 | 2/1987 | Norris | 225/37 |
| 4,934,575 | 6/1990 | Mustafa | 225/38 |

*Primary Examiner*—Eugenia Jones
*Attorney, Agent, or Firm*—Timmons & Kelly

[57] ABSTRACT

Dispensably different supplies, such as plastic wrap, wax paper, metal foil or sandwich bags can be stored in a common cylindrical dispenser, having an inner wall dividing the interior into a plurality of individual compartments. A curved door gives access to each compartment, and an opening in one door allows bulk items to be withdrawn from the dispenser. Rolled material is drawn through a gap, and torn off by pulling the material against a serrated cutter. Plastic wrap can be cut off using a blade cutter mounted on the side of the dispenser. The dispenser can be mounted vertically on a turntable, or horizontally from a bracket or cabinet.

13 Claims, 6 Drawing Sheets

DISPENSER FOR SUPPLIES

BACKGROUND OF THE INVENTION

This application is a continuation-in-part of application Ser. No. 07/928,305 filed Aug. 12, 1992 now abandoned.

1. Field of the Invention

This invention relates in general to dispensers for dispensing a variety of dispensably different supply materials, such as metal foil, plastic wrap, sandwich bags, and similar items.

2. Description of Related Art Including Information disclosed under 37 CFR §§ 1.97–1.99

It is important for kitchen supplies to be handy. Work in a kitchen is difficult enough wothout having to search for needed supplies, such as metal foil, plastic wrap, or sandwich bags. The dispenser of the invention is designed to keep these supplies nearby, easy to get to, and available from a single common dispenser.

Most kitchen supplies are usually kept individually in cabinets, drawers, or cupboards. Whenever a person needs something like a piece of wrapping paper or metal foil, the person has had to open a drawer, remove the individual box, tear off a piece of material, return the box to the drawer, and close the drawer.

In some cases, rolled material, such as plastic wrap or metal foil, has been mounted individually on a dowel under a cabinet. This places the material in a more convenient location, but may not provide a cutter for easily cutting the material while still requiring that each material to be supplied be provided from an individual dispensing source.

SUMMARY OF THE INVENTION

The general object of the invention is to provide a dispenser for dispensing a variety of dispensably different kitchen supplies, such as metal foil, plastic wrap, and sandwich bags from a common dispenser. In general, this object is accomplished by a dispenser having a circular top, a circular bottom, and a cylindrical side. A portion of the side is formed as a pair of doors, providing access to different compartments within the dispenser.

One of the compartments has a holder, such as a dowel, for holding a roll of material, such as plastic wrap. A serrated cutter may be mounted on the edge of the door or on the side of the dispenser. For rolled material such as plastic wrap, a blade cutter may be mounted on the side of the dispenser.

A removable container may be housed within one of the compartments for containing kitchen supplies such as sandwich bags. An opening in the door may allow the bags to be withdrawn from the container.

The dispenser may be mounted on a turntable, so that the longitudinal axis of the dispenser is vertical. Alternatively, the dispenser may be hung from a cabinet in a horizontal position.

The above, as well as additional objects, features, and advantages of the invention will become apparent in the following detailed description.

DESCRIPTION OF THE PREFERRED EMBODIMENT

Figure 1:
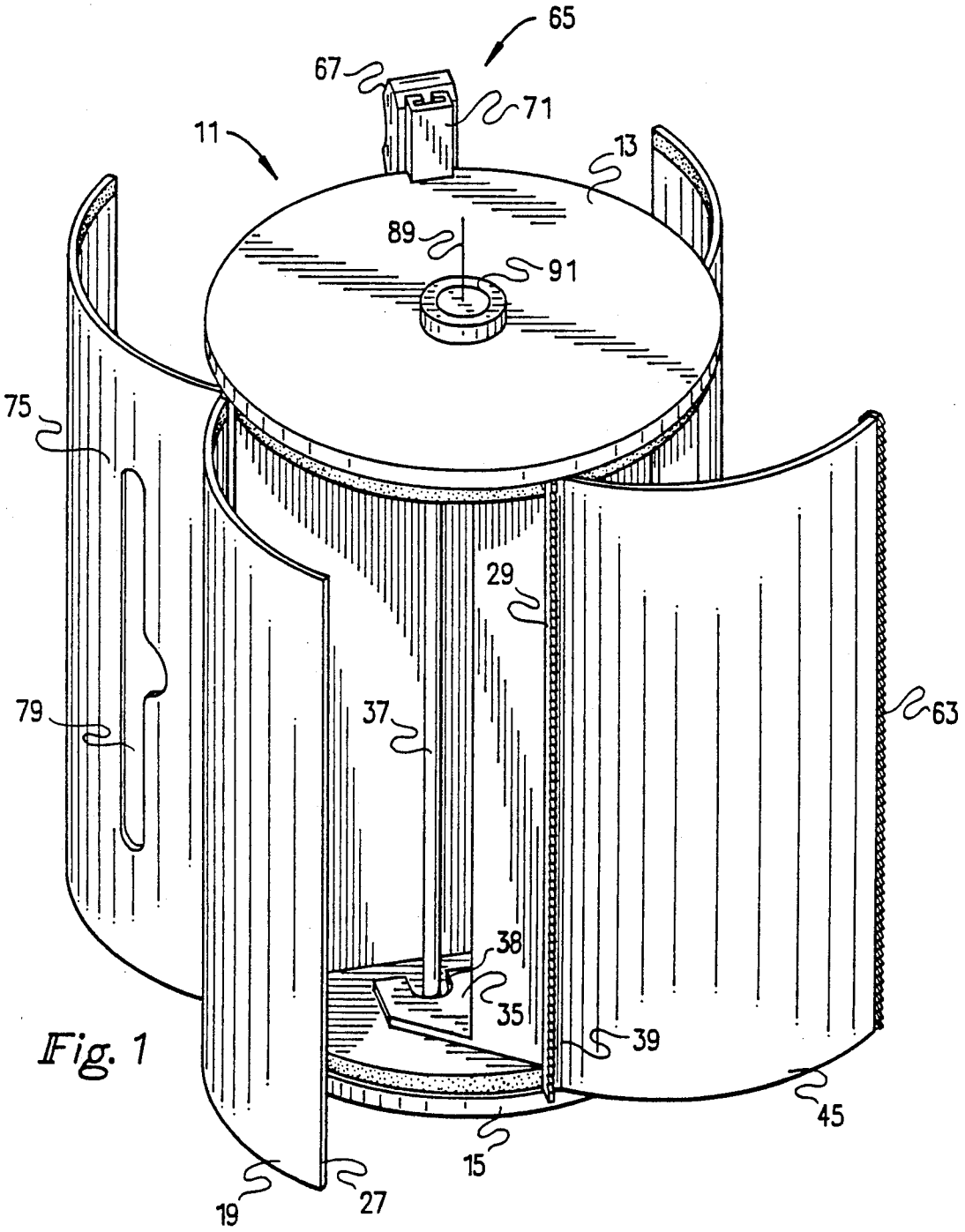
FIG. 1 is a perspective view of a dispenser according to the invention.

The dispenser 11 of the invention has a circular top 13 and a circular bottom 15. A tubular cylindrical side 17 connects the top 13 to the bottom 15, forming a cylindrical dispenser 11 having a plurality of individual compartments from which dispensably different materials can be dispensed.

Forming one portion of the side 17 of the dispenser 11 is a curved door 19, which opens about a vertical hinge 21. This first door 19 is secured by a snap closure between the door 19 and the top 13 of the dispenser 11. The door 19 is about one quarter of the circumference of the side 17, and there is defined a gap 25 of about one inch at the outer edge 27 of the door 19. A vertical serrated cutter 29 is mounted on the side 17 of the dispenser 11 along the gap 25 opposite the edge of door 19.

Figure 8:
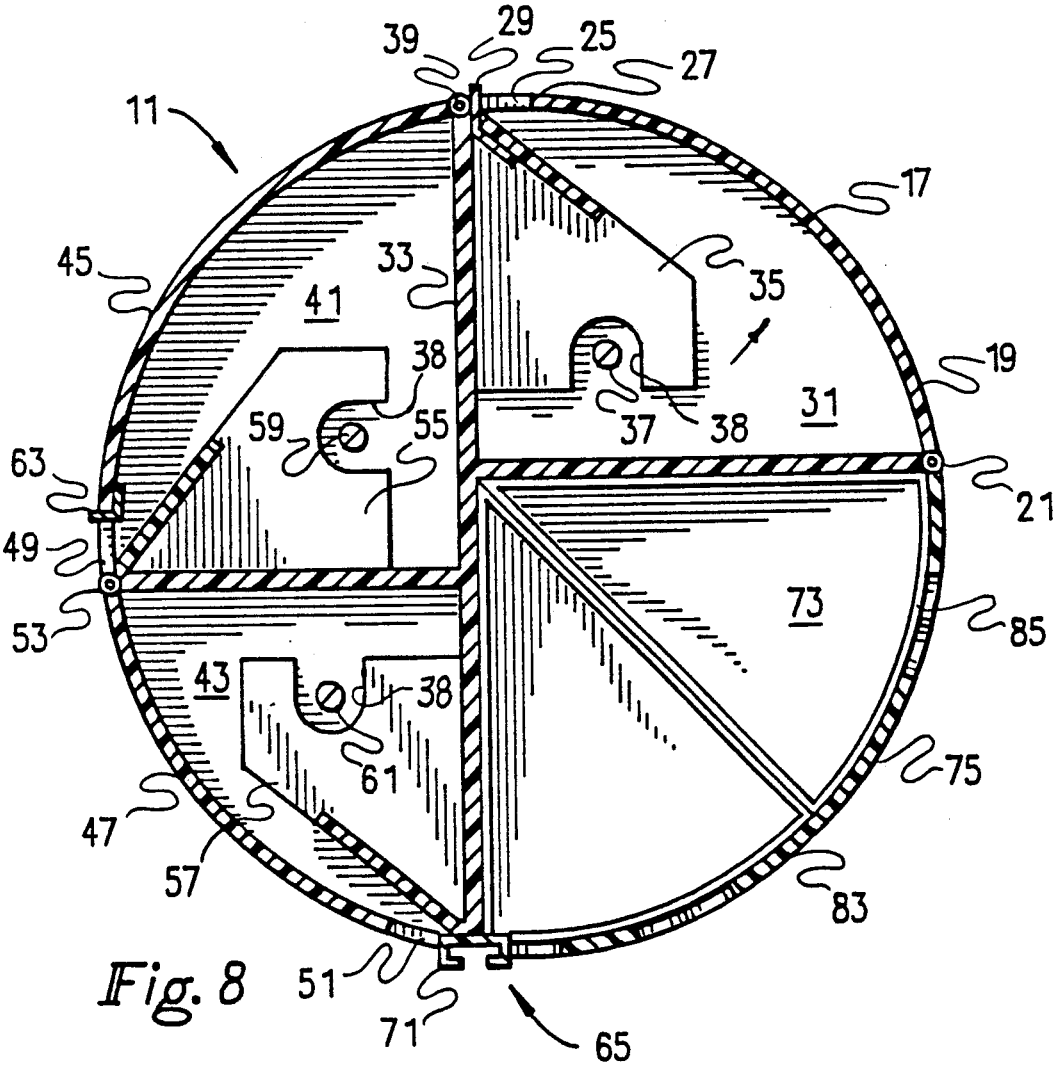
FIG. 8 is a cross sectional view, taken along lines 8—8 in FIG. 2.

The first door 19 provides access to a first compartment 31 within the interior of the dispenser 11, formed by an inner wall 33. As shown in FIG. 8, the inner wall 33 divides the interior of the dispenser 11 into several individual compartments. The first compartment 31 is about one quarter of the interior of the dispenser 11, large enough to house a roll of material, such as a roll of plastic wrap, wax paper, or metal foil in an axial orientation between top 13 and bottom 15.

A pair of brackets 35 top and bottom (one shown) and a dowel 37 hold the roll of material within the compartment 31. Dowel 37, is dimensioned in length for its ends to closely fit and be self supporting when axially extended between the interior surfaces of top 13 and bottom 15. When properly located, the dowel is received and secured within cutouts 38 of the opposite brackets 35.

The bracket 35 is made to pivot outward about a hinge 39, to displace dowel 37 in the course of pivotting toward door 19 and allow easier replacement of the rolled material. The dowel 37 is removed and a fresh roll of material is placed on the dowel 37. The dowel 37 is positioned between cutouts 38 and displaced within compartment 31 to its dispensing position by pivotting bracket 35 inward. The roll of material is then unrolled until the end of the roll extends through the gap 25. The gap allows the end of the roll to be easily grasped and a selected amount of the rolled material can then be pulled out of the compartment 31. The material can then be torn off by pulling the material against the serrated cutter 29.

The dispenser 11 has two other compartments 41 and 43 that are similar to the first compartment 31. These compartments 41 and 43 also have curved doors 45 and 47, totalling about one half of the circumference of the dispenser side 17, but leaving two gaps 49 and 51. One of the doors 45 opens about the hinge 39, and the other door opens about another vertical hinge 53. Each of these compartments 41 and 43 contains a pivotal bracket 55 and 57, and a dowel 59 and 61, for holding a roll of material similarly as described supra for compartment 31.

These other two compartments 41 and 43 are similar but differ in the manner in which the dispensed rolled material is cut. In one compartment 41, the door 45 has a serrated cutter 63 mounted on the edge of the door 45. The material is pulled out of the compartment 41 through the gap 49 and against the serrated cutter 63. This method of cutting the material is preferred over the use of the serrated cutter 29 on the side 17 of the dispenser 11.

The other compartment 43 has a blade cutter 65. The blade cutter 65 has a handle 67 and a sharp blade 69 that rides along a vertical guide 71. The material is pulled out of the compartment 43 through the gap 51 and held against the guide 71. The handle 67 is grasped and the blade 69 is forced along the guide 71 to sever the material. The blade cutter 65 is particularly effective with nonperforated material, such as plastic wrap.

The remainder of the interior of the dispenser 11 is a second kind of compartment 73. This second compartment 73 occupies about one quarter of the interior and access to the compartment 73 is provided by a curved door 75. The door 75 pivots about the same hinge 21 as the first door 19, and has a pair of central openings 77 and 79. There is no gap between the edge of the door 75 and the side 17 of the dispenser 11, but there is a notch 81 to facilitate opening the door 75.

The second compartment 73 houses a pair of wedge-shaped containers 83 and 85. These containers 83 and 85 are only a few inches deep, and are designed to contain supplies such as sandwich bags. The bags can be withdrawn through the openings 77 and 79 in the door 75. To replace the supplies, the door 75 can be opened, and the containers 83 and 85 can be removed from the compartment 73. The containers 83 and 85 could also be made to tilt forward out of the compartment 73.

Figure 2:
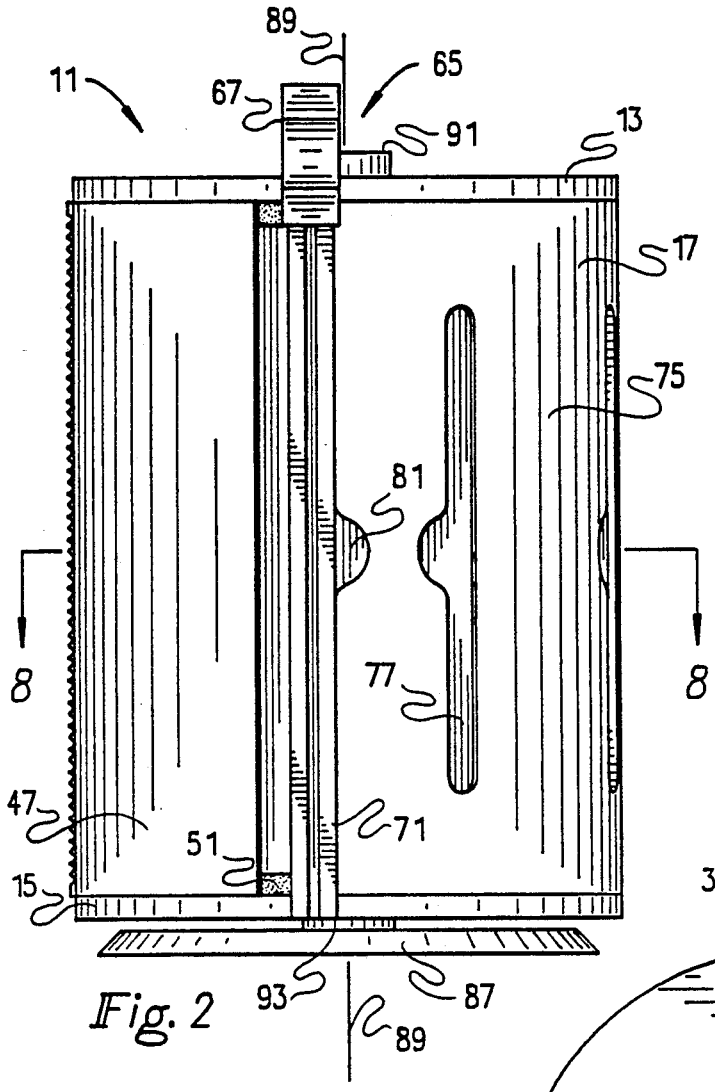
FIG. 2 is a front elevation of the dispenser.
Figure 6:
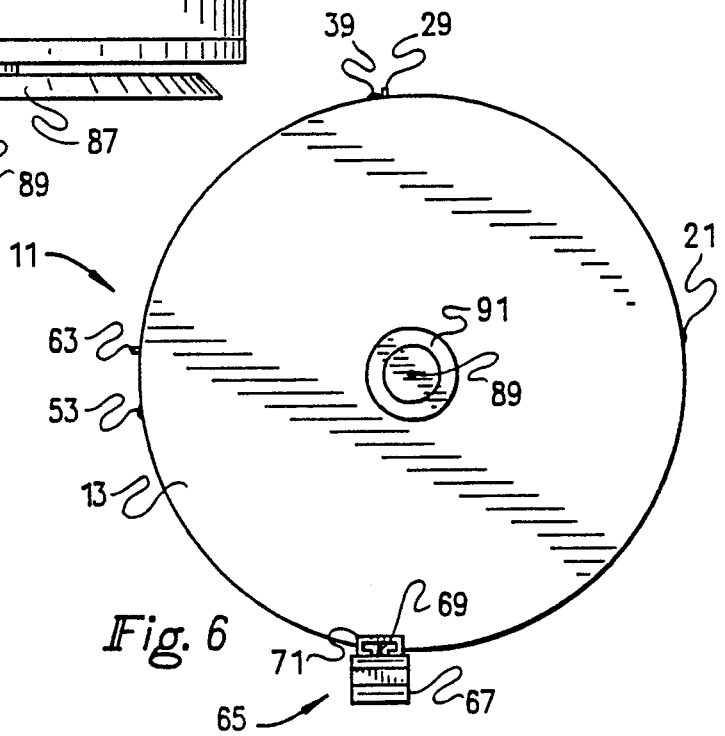
FIG. 6 is a top plan view of the dispenser.
Figure 3:
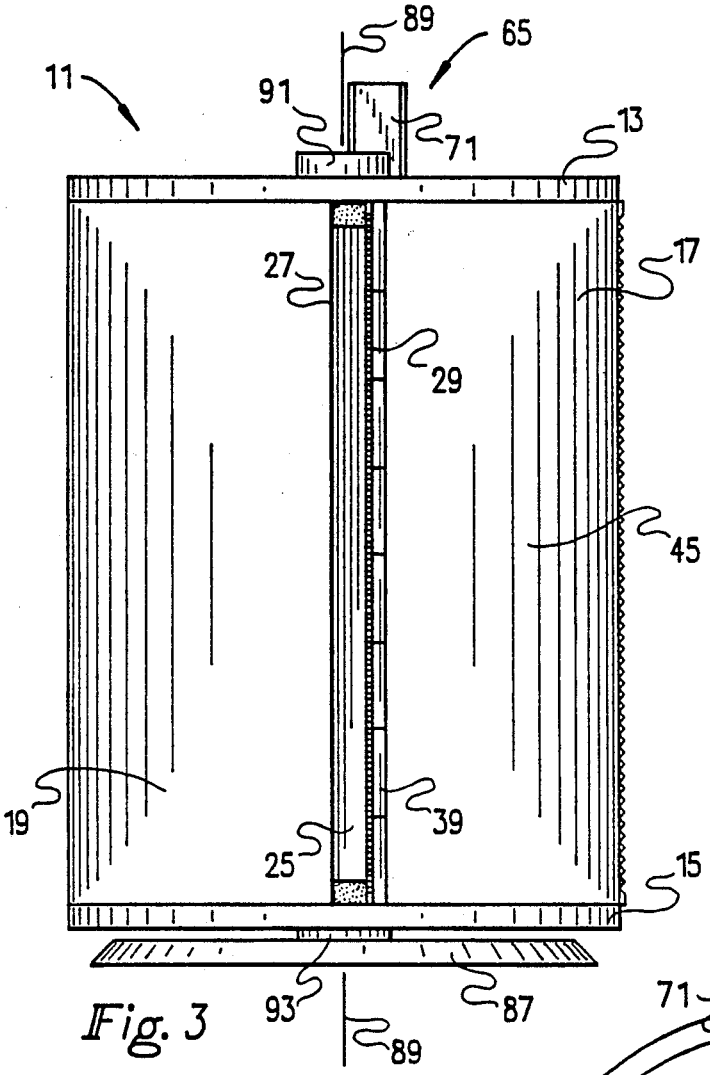
FIG. 3 is a rear elevation of the dispenser.
Figure 7:
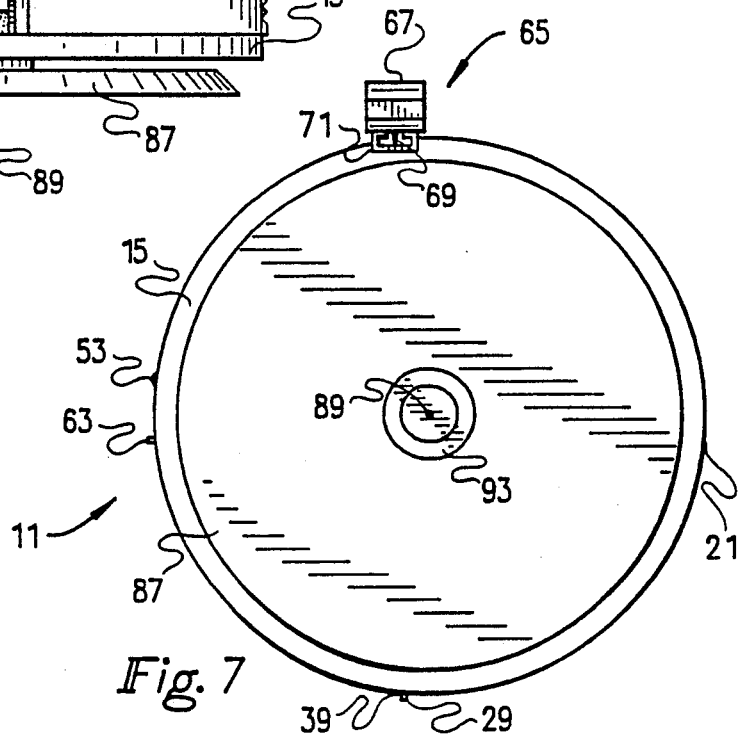
FIG. 7 is a bottom plan view of the dispenser.
Figure 4:
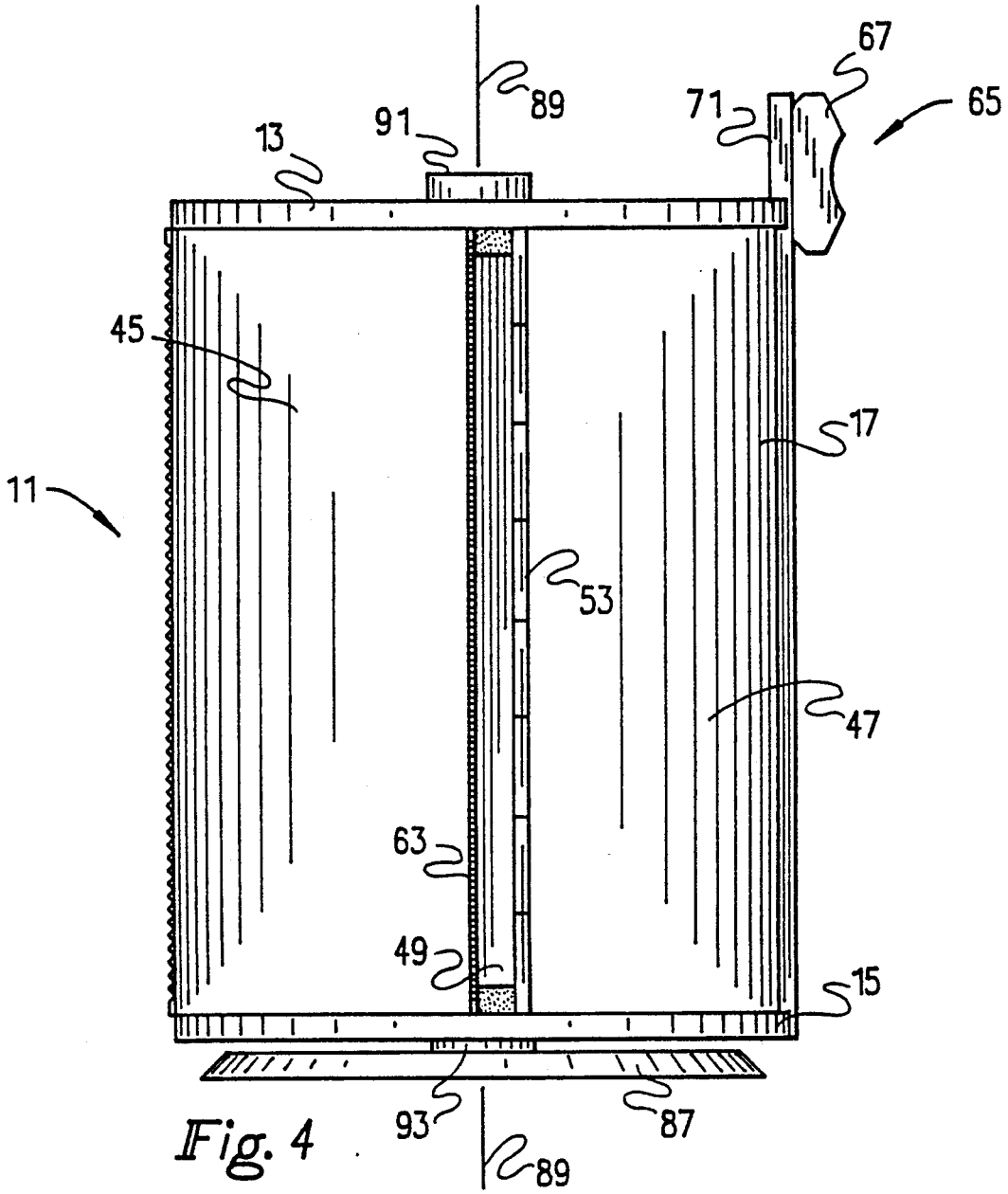
FIG. 4 is a right side elevation of the dispenser.
Figure 5:
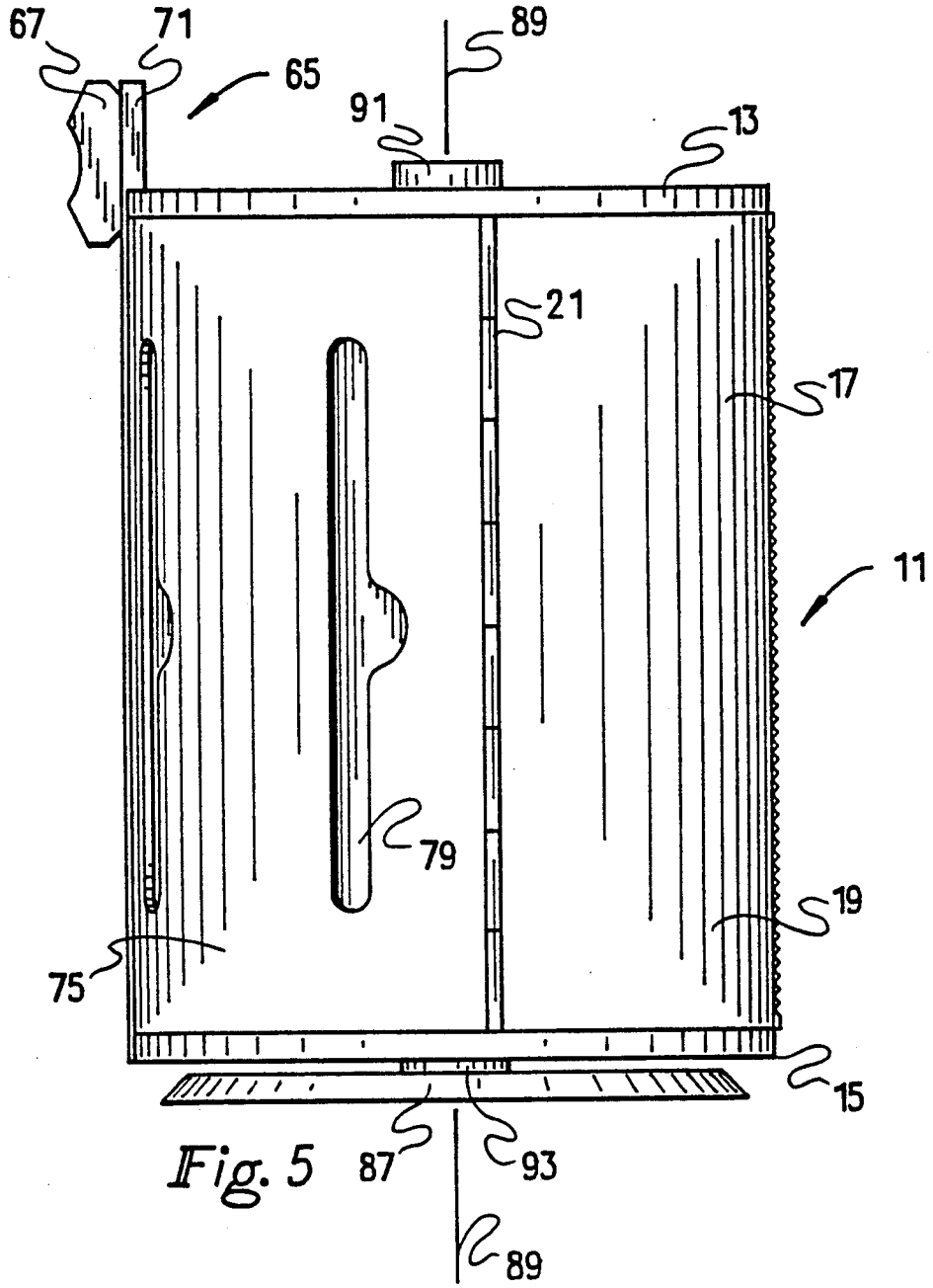
FIG. 5 is a left side elevation of the dispenser.

The dispenser 11 is preferably mounted on a turntable 87, (FIG. 2) so that the dispenser 11 can be rotated about its longitudinal axis 89. The dispenser 11 may also have cylindrical projections 91 and 93 on the top 14 and bottom 15, to provide a mounting means for hanging the dispenser 11 from a cabinet.

The invention has several advantages over the prior art. The dispenser 11 provides a convenient and easy-to-use supply source to store dispensably different supplies. Both rolled materials and bulk materials can be stored in the same dispenser 11. The dispenser 11 can be placed vertically on a turntable 87 or hung horizontally from a cabinet.(not shown) Also, it is easy to replenish the supplies when necessary.

The invention has been shown and described in only one embodiment. It should be apparent to those skilled in the art that the invention is not so limited, but is susceptible to various changes and modifications without departing from the spirit of the invention.

I claim:

1. A dispenser for dispensing a variety of dispensably different supply materials comprising:

a top;

a bottom;

a side, connecting the top to the bottom wherein a portion of the side defines a first door and a second door separate from said first door for providing access to the interior of the dispenser;

an inner wall dividing the interior of the dispenser into at least one first compartment to contain and from which to dispense a continuous feed from a roll of supply material and at least one second compartment to contain and from which to dispense a successive feed from a source of non-rolled supply material wherein each door provides access to one of said compartments;

draw means associated with the doors of said compartments to enable withdrawing a predetermined quantity of supply material from said compartments; and a holder for supporting the roll of supply material within said first compartment; said holder comprising opposite brackets mounted for pivotal displacement between a first position within said first compartment for securing a supported roll in a dispensing location and a second position within said first compartment relatively closer to the door of said first compartment to enable enhanced replacement access to the supported roll.

2. A dispenser as recited in claim 1 in which said holder includes an elongated dowel on which to support said roll of supply material, the opposite ends of said dowel are adapted to effect a supporting engagement between interior surfaces of said top and bottom and said brackets each include a cutout through which said dowel ends extend while engaging said top and bottom surfaces.

3. A dispenser as recited in claim 1 wherein said first door provides access to said first compartment and said second door provides access to draw means second compartment and the side includes a gap between said first door and the remainder of the side through which the material can be drawn from said supported roll.

4. A dispenser as recited in claim 3, including a cutter associated with said draw means for cutting the drawn material to a selected length.

5. A dispenser as recited in claim 4, wherein the cutter is serrated and is mounted on an outer edge of said first door.

6. A dispenser as recited in claim 4, wherein the cutter is serrated and is mounted on the side of the dispenser juxtaposed to an outer edge of said first door.

7. A dispenser as recited in claim 4, wherein the cutter further comprises:

a vertical guide attached to the side of the dispenser; and a blade that displaceably rides along the vertical guide for cutting material drawn from said first compartment.

8. A dispenser as recited in claim 3, wherein the draw means further includes an opening in the second door through which supplies can be drawn from the second compartment without opening the door.

9. A dispenser as recited in claim 8, further comprising a removable container for holding supplies in the second compartment.

10. A dispenser as recited in claim 9, further comprising mounting means for hanging the dispenser from a cabinet in a position in which the longitudinal axis of the dispenser is horizontal.

11. A dispenser as recited in claim 9, further comprising a turntable, mounted under the bottom of the dispenser, for allowing the dispenser to turn about its longitudinal axis.

12. A dispenser as recited in claim 1 further comprising:

a removable container for supporting the non-rolled supply material in said second compartment; and a turntable, mounted under the bottom of the dispenser, for allowing the dispenser to turn about its longitudinal axis.

13. A dispenser as recited in claim 1, further comprising a plurality of said first compartments from which to dispense a continual feed of different rolled supply materials.

* * * * *